US005860603A

United States Patent [19]

Raghu et al.

[11] Patent Number: 5,860,603

[45] Date of Patent: Jan. 19, 1999

[54] LOW PRESSURE, FULL COVERAGE FLUIDIC SPRAY DEVICE

[75] Inventors: Surya Raghu, Columbia; Ronald D. Stouffer, Silver Spring, both of Md.

[73] Assignee: Bowles Fluidics Corporation, Columbia, Md.

[21] Appl. No.: 768,935

[22] Filed: Dec. 18, 1996

Related U.S. Application Data

[63] Continuation-in-part of Ser. No. 713,276, Sep. 12, 1996, abandoned.

[51] Int. Cl.[6] ..... B05B 1/08

[52] U.S. Cl. ..... 239/589.1

[58] Field of Search ..... 137/808–812, 137/833, 834, 835, 839; 239/589.1, 101

[56] References Cited

U.S. PATENT DOCUMENTS

| | | | |
|---|---|---|---|
| 3,563,462 | 2/1971 | Bauer | 137/835 |
| 4,151,955 | 5/1979 | Stouffer | 137/835 |
| 4,562,867 | 1/1986 | Stouffer | 239/589.1 |

FOREIGN PATENT DOCUMENTS

| | | | |
|---|---|---|---|
| 305996 | 3/1989 | European Pat. Off. | 239/589.1 |
| 79/00361 | 6/1979 | WIPO | 137/811 |

*Primary Examiner*—Kevin Weldon
*Attorney, Agent, or Firm*—Jim Zegeer, Esq.

[57] ABSTRACT

A two-stage liquid spray device having an outlet region with an island and an exit aperture and a fluidic oscillator, driving said outlet region. The improvement for the spray device is operable at low pressure to achieve full-area coverage with substantially uniform droplets and wherein all of the spray droplets land on the desired work surface and do not bounce. The fluidic oscillator includes an oscillation chamber, a power nozzle for introducing a jet of liquid from a source into the oscillation chamber. The oscillation chamber is configured to produce a pair of alternating control vortices which substantially preclude wall attachment of said jet traversing said oscillation chamber thus avoiding a heavy endedness in the oscillatory jet. An outlet from the oscillation chamber to the outlet region, whereby the jet rhythmically sweeps in end pulses to each side of the island and form a sheet at the exit aperture. The sheet is rhythmically waved or swept in the ambient air to form the uniform droplets. A transverse slot defines the lateral boundary of the sweeping sheet.

5 Claims, 3 Drawing Sheets

LOW PRESSURE, FULL COVERAGE FLUIDIC SPRAY DEVICE

RELATED APPLICATION

This application is a continuation-in-part application of application Ser. No. 08/713,276 filed Sep. 12, 1996, now abandoned entitled LOW PRESSURE, FULL COVERAGE FLUIDIC SPRAY DEVICE.

BACKGROUND OF THE INVENTION

FIG. 1 hereof, from Stouffer U.S. Pat. No. 4,151,955 (incorporated herein by reference), discloses a two-stage fluidic spray device in which a wall attachment, heavy-ended type of fluidic oscillator 10 drives a generally circular outlet region or chamber 11. Outlet region 11 has a substantially concentric island 12 which converts the fluidically swept jet issuing from fluidic oscillator to sweeping sheet. FIG. 2, from Stouffer U.S. Pat. No. 4,508,267 (incorporated herein by reference) discloses a liquid oscillator for producing a unidirectional swept jet for producing a fan spray 16 with resulting liquid droplets of uniform size. The oscillation chamber has sidewalls which are shaped to produce alternating control vortices in the oscillation chamber 17 and preclude the wall attachment effects which make the fluidic oscillator portion or spray shown in FIG. 1 heavy-ended.

We have discovered that a two-stage liquid spray device having an outlet region with an island of the type illustrated in Stouffer U.S. Pat. No. 4,151,955 and a fluidic oscillator of the type shown in Stouffer U.S. Pat. No. 4,508,267 can be operated at low pressure (as from a pumped source or a plastic squeeze container) to achieve full-area coverage with substantially uniform droplets and wherein all of the spray droplets land on the desired work surface and do not bounce. In other words, the liquid droplets stay on the work surface in the desired pattern.

The exit aperture from the outlet stage to ambient is provided with a transverse groove to define the extent of the oscillating liquid sheet forming the spray.

The object of the present invention is to provide a liquid spray device for full area coverage which operates at low pressure and velocity and which produces substantially uniform droplets in the full area coverage spray.

According to a preferred embodiment of the invention, a two-stage fluidic spray device in which a fluidic oscillator has an oscillation chamber with mirror image sidewalls shaped to produce alternate control vortices that cause the power jet to oscillate back and forth in the oscillation chamber without significant wall attachment effects. The output of the fluidic oscillator drives an island type output region. The exit aperture or opening from the outlet region to ambient is provided with an external transverse groove or slot which defines the lateral boundaries of the spray pattern of liquid and substantially eliminates any drip.

BRIEF DESCRIPTION OF THE DRAWINGS

The above and other objects, advantages and features of the invention will become more apparent when considered in conjunction with the following specifications and accompanying drawings, wherein.

DETAILED DESCRIPTION OF THE INVENTION

Figure 2:
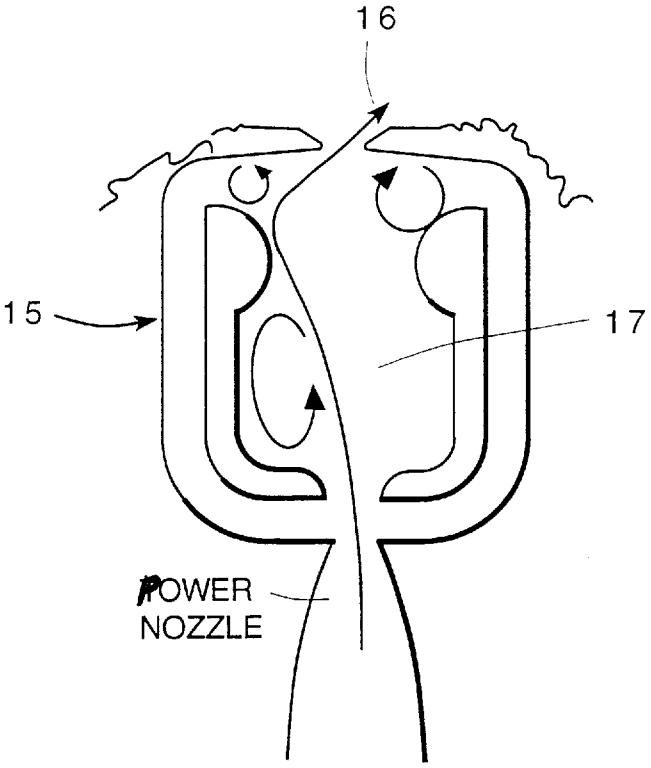
FIG. 2 (PRIOR ART)
FIG. 2 (prior art) is a silhouette of a fluidic oscillator disclosed in Stouffer U.S. Pat. No. 4,508,267.
Figure 1:
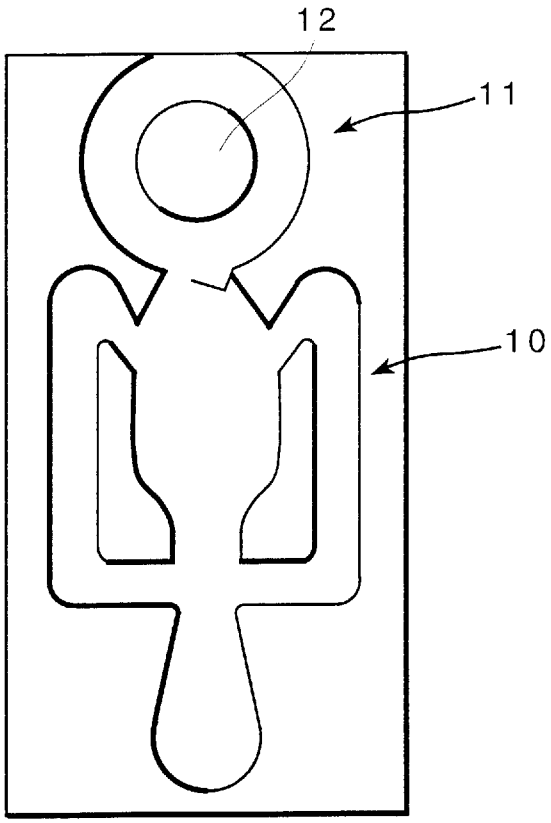
FIG. 1 (PRIOR ART)
FIG. 1 (prior art) is a silhouette of a two-stage spray device disclosed in FIG. 20 of Stouffer U.S. Pat. No. 4,151,955.
Figure 3:
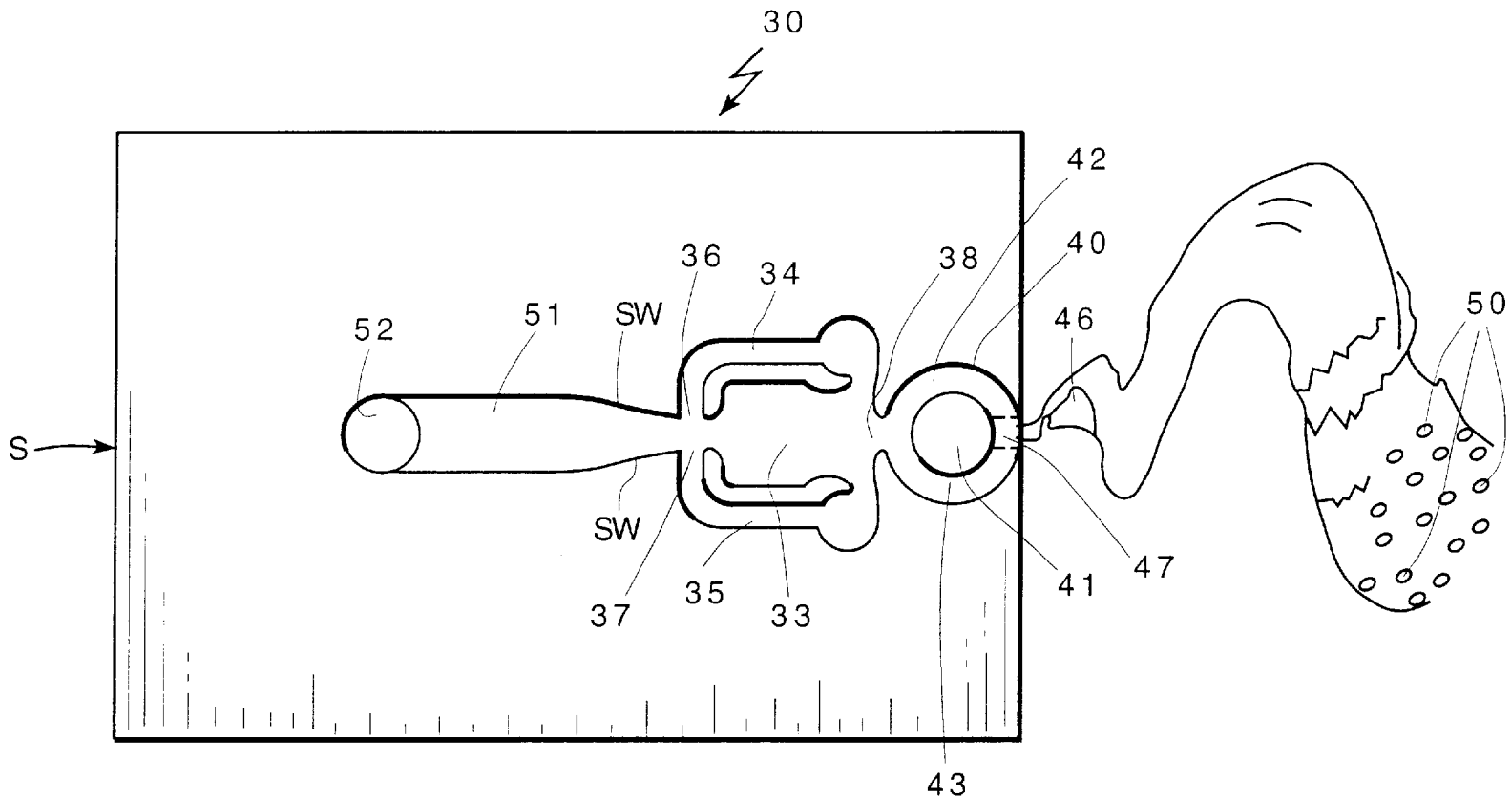
FIG. 3 is a silhouette of a two-stage fluidic spray device incorporating the invention.

Referring now to FIG. 3, a two-stage liquid spray device 30 incorporating the invention has a power nozzle 31 coupled via passage 32 to a source of liquid to be sprayed or dispersed in a predetermined pattern onto a desired surface. The source S may be a pumped source or a plastic squeeze bottle or other source of liquid. The liquid can be a wash/wax, water, etc. liquid. Power nozzle 31 has converging side walls SW and issues a jet of liquid into oscillation chamber 33. As described is Stouffer U.S. Pat. No. 4,508,267, alternating control vortices are formed in the oscillation chamber 33 with the alternating vortices controlling the flow of liquid in control passages 34 and 35 and control ports 36 and 37 causing the liquid jet to rhythmically oscillate back and forth in the oscillation chamber 33. The jet of liquid is swept or oscillated in outlet 38 which constitutes the inlet to outlet region 39 which is constituted by a generally circular (in this embodiment) outlet chamber 40 having outlet island 41. The rhythmic sweeping of the jet of liquid in outlet 38 causes the rhythmic pulsing of liquid in the passages 42 and 43 on the two sides of the island 41 to impinge at tip or point 44 thus producing an oscillating sheet 46 oriented perpendicular to the impingement direction of the liquid jets at the exit 47. The oscillating sheet of liquid 46 breaks up into uniform droplets 50 thus providing a uniform coverage over a predetermined area of the deposit surface.

Figure 5:
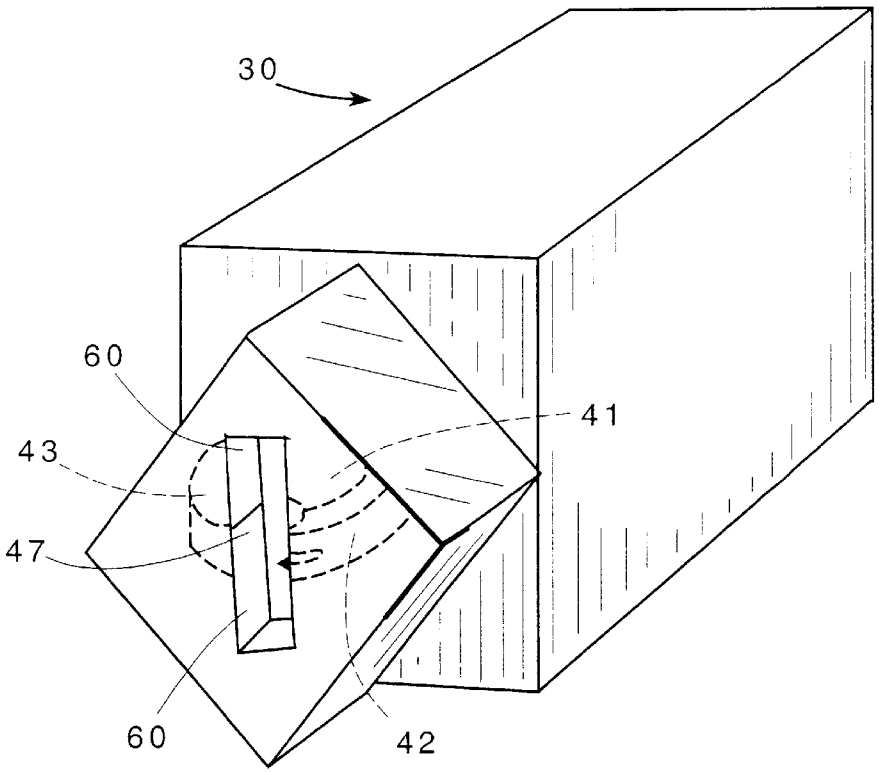
FIG. 5 is an isometric perspective view of a two-stage spray device incorporating the invention.
Figure 4:
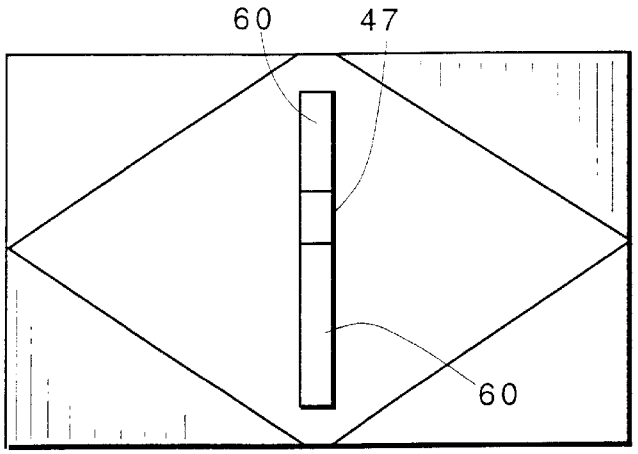
FIG. 4 is a front elevational view of a two-stage spray device incorporating the invention.

The end of the nozzle is diamond-shaped as shown in FIGS. 4 and 5, and laterally extending groove or channel 60 is provided to define the boundary of the oscillating sheet where it leaves exit 47 to obtain the desired shape of the spray. The groove 60 is also designed to drain off the accumulating liquid at the edges. The slot or groove 60 geometry produces the required expansion of the oscillating sheet of liquid issuing to ambient through the outlet aperture 47.

While I have shown and described preferred embodiments of the invention, it will be appreciated that other embodiments, modifications and adaptations of the invention will become readily apparent to those skilled in the art.

What is claimed is:

1. In a two-stage liquid spray device having an outlet region with an island therein and an exit aperture and a fluidic oscillator connected to and driving said outlet region, the improvement comprises:

said fluidic oscillator includes an oscillation chamber, a power nozzle for introducing a jet of liquid from a liquid source into said oscillation chamber, said oscillation chamber mirror image sidewalls being shaped to produce a pair of alternating control vortices which substantially preclude wall attachment effects of said jet traversing said oscillation chamber, and an outlet from said oscillation chamber to said outlet region, whereby said jet rhythmically sweeps in said outlet and rhythmical pulses on each side of said island to said exit aperture, and a sheet of liquid is swept to form said uniform droplets whereby said spray device achieves full-area coverage with substantially uniform liquid droplets and wherein all of the spray droplets land on a selected work surface.

2. The spray device defined in claim 1 including a slot extending transverse to said exit aperture for defining the boundary of said sweeping sheet.

3. In a two-stage liquid spray device for spraying a selected work surface, and two-stage spray device having an outlet region with an island therein and an exit aperture for delivering said liquid to said selected work surface and a fluidic oscillator connected to and driving said outlet region, wherein the improvement comprising:

said fluidic oscillator includes an oscillation chamber, a power nozzle for introducing a jet of liquid from a liquid source into said oscillation chamber, said oscillation chamber having substantially mirror image sidewalls shaped to produce a pair of alternating control vortices which substantially preclude wall attachment effects of said jet traversing said oscillation chamber, an outlet from said oscillation chamber to said outlet region, whereby said jet rhythmically sweeps in said outlet and rhythmical pulses on each side of said island to said exit aperture, and a sheet of liquid issues through said exit aperture and is swept to form said uniform drops.

4. The spray device defined in claim 3 including a slot extending transverse to said exit aperture for defining the lateral ends of said sweeping sheet.

5. In a two-stage liquid spray device having an outlet region with an island and an exit aperture and a fluidic oscillator, driving said outlet region, wherein the improvement comprises:

said fluidic oscillator including an oscillation chamber, a power nozzle for introducing a jet of liquid from a liquid source into the oscillation chamber, said oscillation chamber having mirror image sidewalls shaped to produce a pair of alternating control vortices which substantially preclude wall attachment of said jet traversing said oscillation chamber, an outlet from said oscillation chamber connected to said outlet region, whereby the jet rhythmically pulses to each side of said island to form a sweeping sheet at said exit aperture to form the uniform droplets, and a transverse slot contiguous to said exit aperture for defining the lateral boundary of the sweeping liquid sheet.

* * * * *